US005762514A

United States Patent [19]

Long et al.

[11] Patent Number: 5,762,514

[45] Date of Patent: Jun. 9, 1998

[54] CONNECTOR WITH AFFIXABLE LATCH MEMBER

[75] Inventors: Michael David Long, Harrisburg; Earl William McCleerey, Mechanicsburg, both of Pa.

[73] Assignee: The Whitaker Corporation, Wilmington, Del.

[21] Appl. No.: 804,763

[22] Filed: Feb. 24, 1997

[51] Int. Cl.[6] ..... H01R 13/627

[52] U.S. Cl. ..... 439/358

[58] Field of Search ..... 439/358, 357, 439/372, 352, 350, 345

[56] References Cited

U.S. PATENT DOCUMENTS

| | | | |
|---|---|---|---|
| 4,682,836 | 7/1987 | Noorily et al. | 439/426 |
| 4,801,275 | 1/1989 | Ikeda et al. | 439/358 |
| 4,838,808 | 6/1989 | Fujiura | 439/357 |
| 4,873,614 | 10/1989 | Lichtensperger | 439/358 |
| 4,944,693 | 7/1990 | Puerner | 439/358 |
| 4,979,910 | 12/1990 | Revil et al. | 439/357 |
| 5,344,335 | 9/1994 | Scholz et al. | 439/357 |
| 5,350,317 | 9/1994 | Weaver et al. | 439/350 |
| 5,382,177 | 1/1995 | Hutchinson, Jr. et al. | 439/358 |
| 5,383,794 | 1/1995 | Davis et al. | 439/352 |
| 5,588,864 | 12/1996 | Lin | 439/357 |
| 5,591,042 | 1/1997 | Takata et al. | 439/354 |

*Primary Examiner*—J. J. Swann
*Assistant Examiner*—Tho D. Ta
*Attorney, Agent, or Firm*—Anton P. Ness

[57] ABSTRACT

Connector (10) having a housing (12) and a latching member (30) mountable thereto at a fastening site (32) with a latching end (34) adjacent a mating face (18) and an elongate actuation arm (36) extending rearwardly along the connector and biased away therefrom. The latching member (30) is pivotable when actuated to delatch from a mating connector (42), by movement of actuation arm (36) toward the housing against spring bias to pivot the latching end (34) away from the mating connector to disengage from the latching section (44) thereof. Latching member (30) may be initially separate from the connector to permit selection from a set of latching members of different lengths prior to mounting.

8 Claims, 5 Drawing Sheets

CONNECTOR WITH AFFIXABLE LATCH MEMBER

FIELD OF THE INVENTION

This relates to electrical connectors and more particularly to connectors that are latchable to mating connectors.

BACKGROUND OF THE INVENTION

The use of latching is well known in electrical connectors that are matable with and unmatable from complementary connectors. One such latching system is disclosed in U.S. Pat. No. 5,383,794 wherein a pair of latches are provided along opposed ends of an electrical connector each including a latching section at a free end for latching with and unlatching from corresponding latching sections of a mating connector. Each latch is pivotable rearward from the latching section by actuating a rearward arm, such that manual urging of the rearward arms toward each other pivots the latching sections outwardly to disengage, whereafter the connectors may be pulled apart. Similarly, U.S. Pat. No. 4,944,693 discloses a pair of latch arms that are molded integrally with the housing.

It is desired to provide a latching member where the length of the actuating section is selectable.

SUMMARY OF THE INVENTION

The present invention provides a latching member manually affixable to the connector in the field, that is, remote from the factory, and would be particularly useful where a set of latching members of varying lengths is provided with the connector. The connector's single latching member allows delatching upon actuation.

An elongate member includes a latching end forwardly of a pivot section, and an actuating arm extending rearwardly therefrom. A resilient member biases the latching end inwardly toward the side of the mating connector to remain latched after mating. The actuating arm is movable toward the side of the connector to pivot the latching arm outwardly against the bias force. Preferably, a spring is mounted to the elongate member at the pivot section, and the latching member is affixed to the connector housing at the pivot section. A first latching member may have a long actuating arm, and at least a second may have a short actuating arm but the members are otherwise identical and interchangeable, thereby forming a set associated with the connector to which either one may be mounted as desired.

Embodiments of the present invention will now be described by way of example with reference to the accompanying drawings.

DETAILED DESCRIPTION

Figure 1:
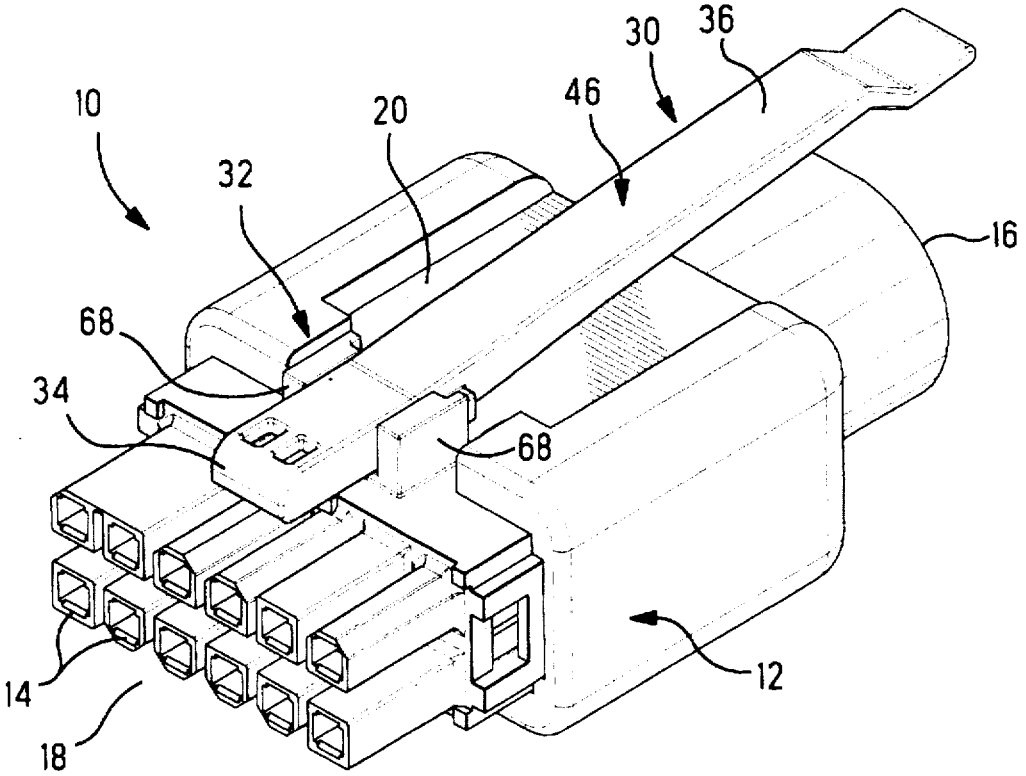
FIGS. 1 and 2 are isometric views of a connector containing the present invention, fully assembled in FIG. 1 and with the latching member exploded from the connector in FIG. 2.
Figure 2:
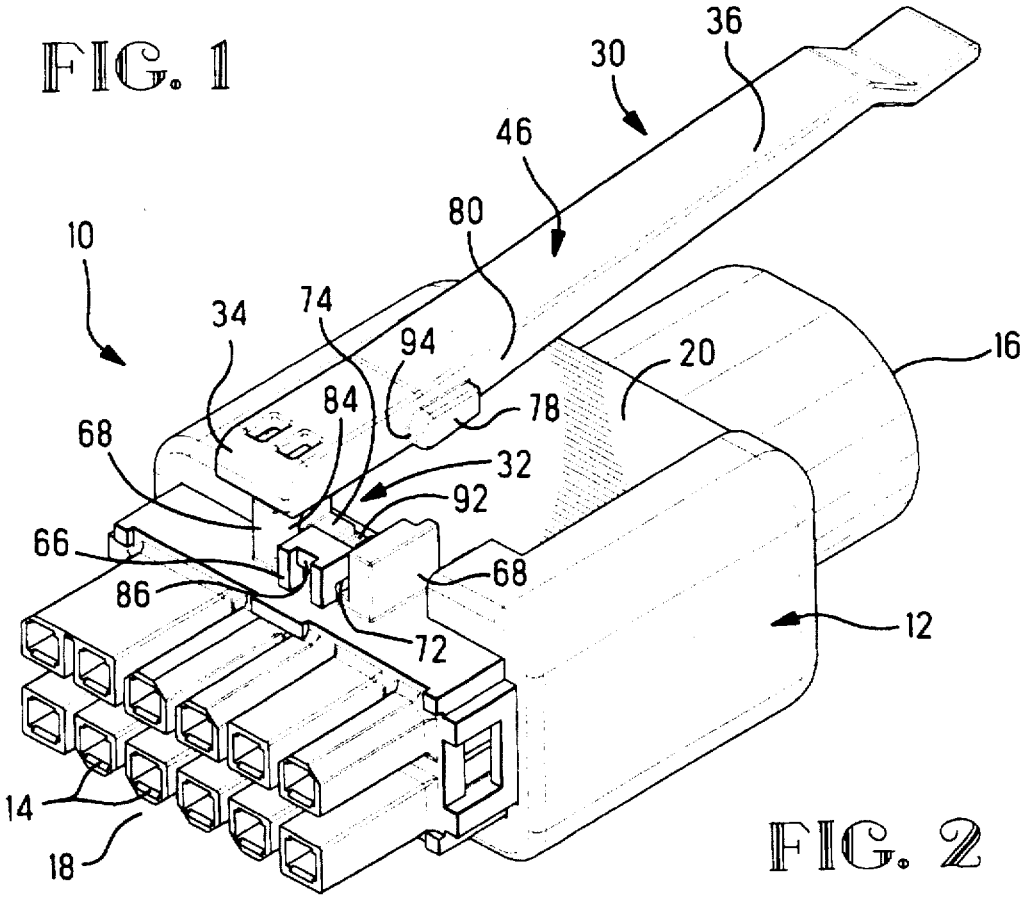

Connector 10 in FIGS. 1 and 2 is shown to have a housing member 12 having a plurality of silos 14 each containing contact sections of contact members (not shown) extending through the connector from a cable exit at the rearward end 16 to the mating face 18 at the forward end. Along one side 20 in FIG. 1 is affixed a latching member 30 at a fastening site 32 and extending forwardly to a latching end 34 adjacent mating face 18, and extending rearwardly to an actuating section 36.

Figure 3:
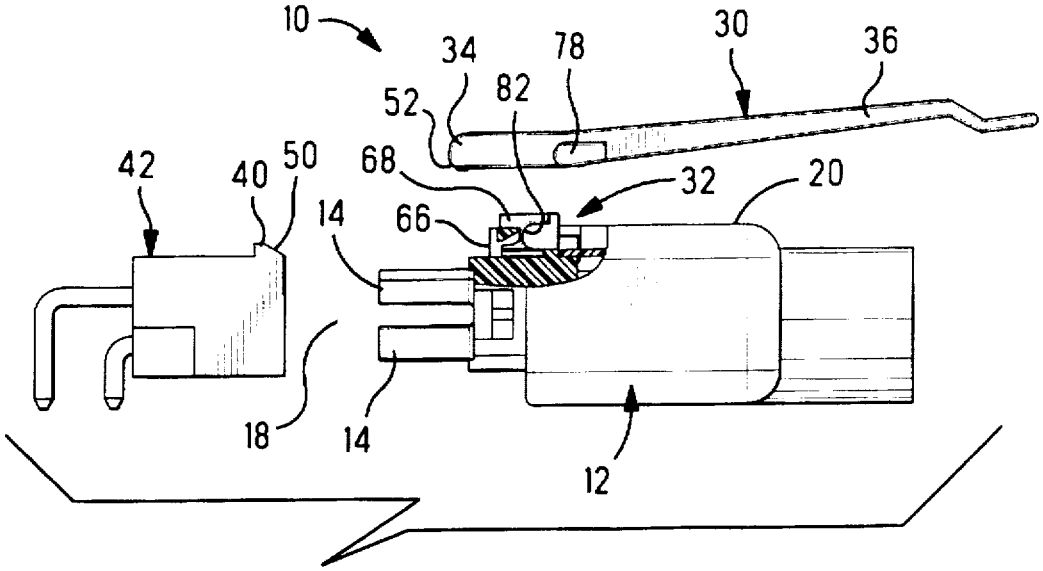
FIGS. 3 and 4 are elevation views of the connector and latching member of FIGS. 1 and 2 and a mating connector, exploded in FIG. 3 and assembled and mated in FIG. 4, partially broken away to reveal the fastening section and also the latching engagement in FIG. 4.
Figure 4:
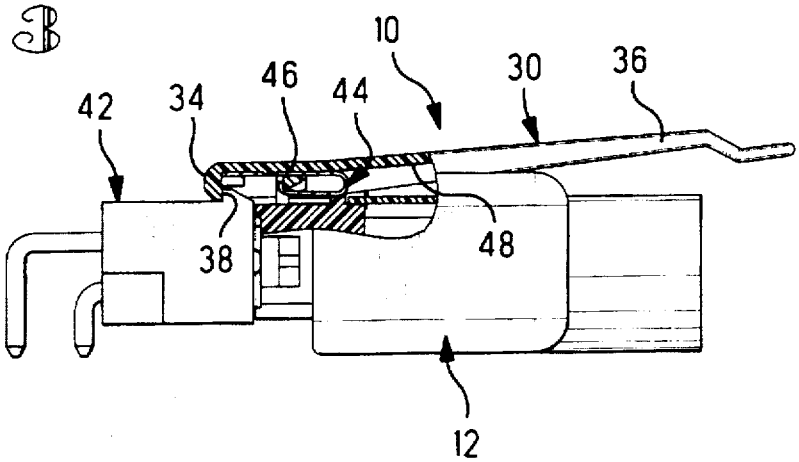
Figure 5:
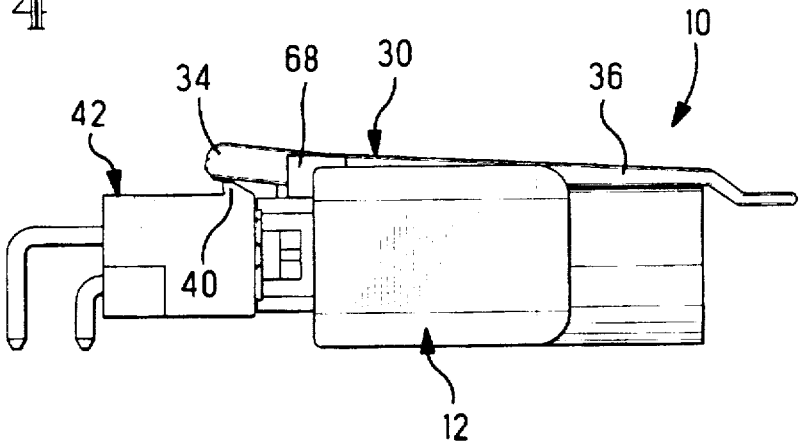
FIG. 5 is an elevation view of the mated connectors illustrating the latching member actuated to delatch from the mating connector.
Figure 6:
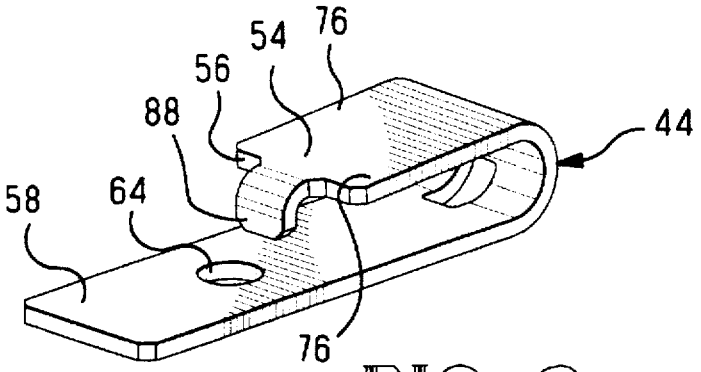
FIG. 6 is an isometric inverted view of the spring section of the latching member.
Figure 7:
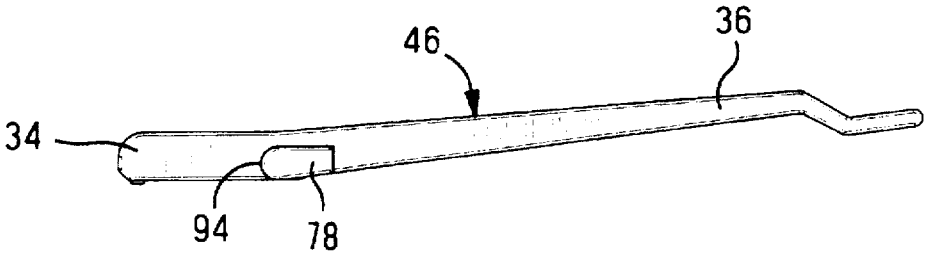
FIG. 7 is an elevation view of the latching member.
Figure 8:
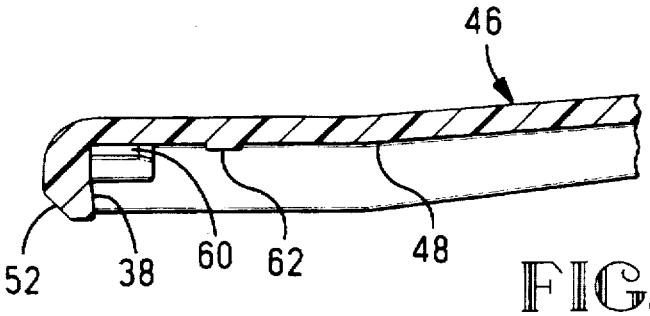
FIG. 8 is a longitudinal section of the forward portion of the elongate latching arm.
Figure 9:
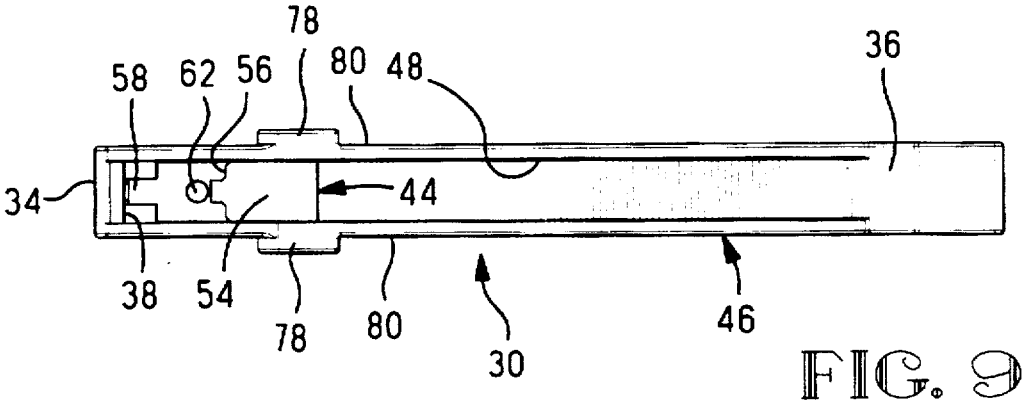
FIG. 9 is a bottom view of the latching member, with the spring member secured to the latching arm.
Figure 10:
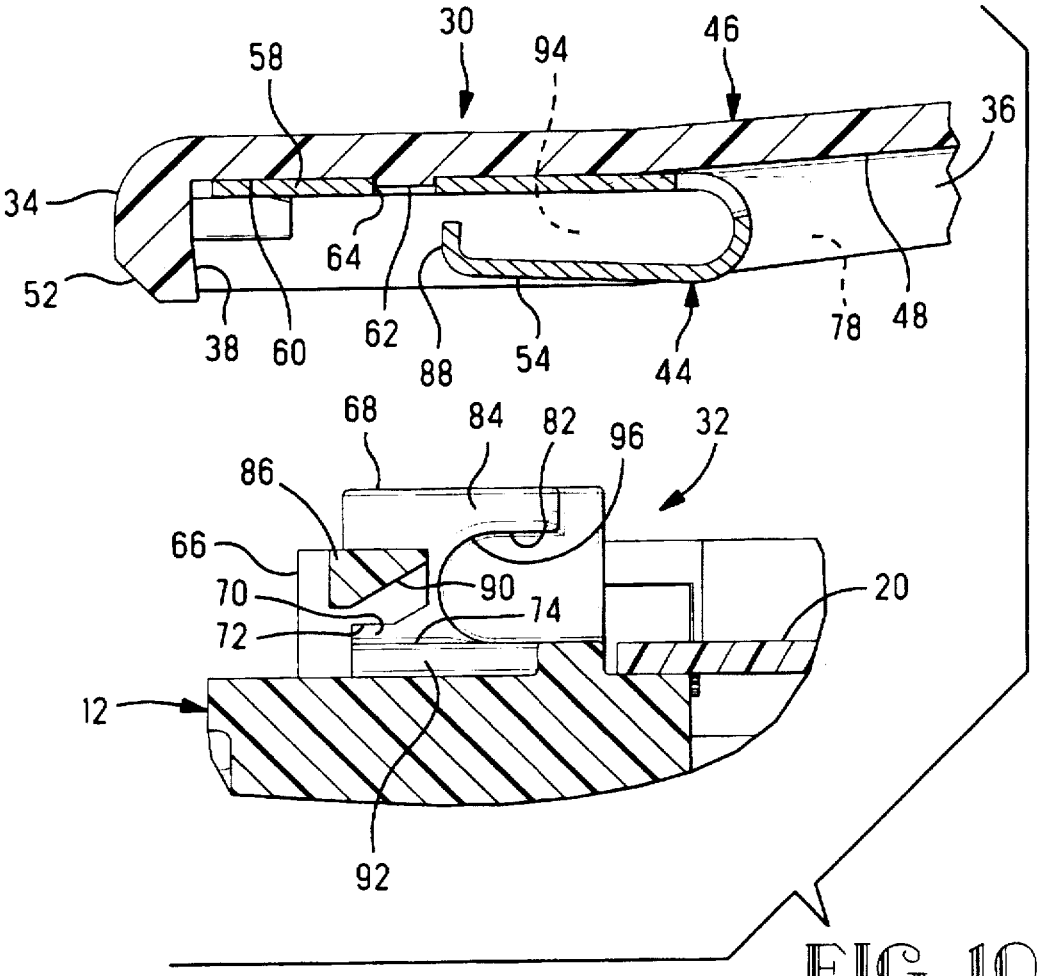
FIGS. 10 to 13 are enlarged section views of the fastening sections of the connector and latching member of FIGS. 1 and 2, exploded, partially assembled in two stages and fully assembled, respectively.
Figure 11:
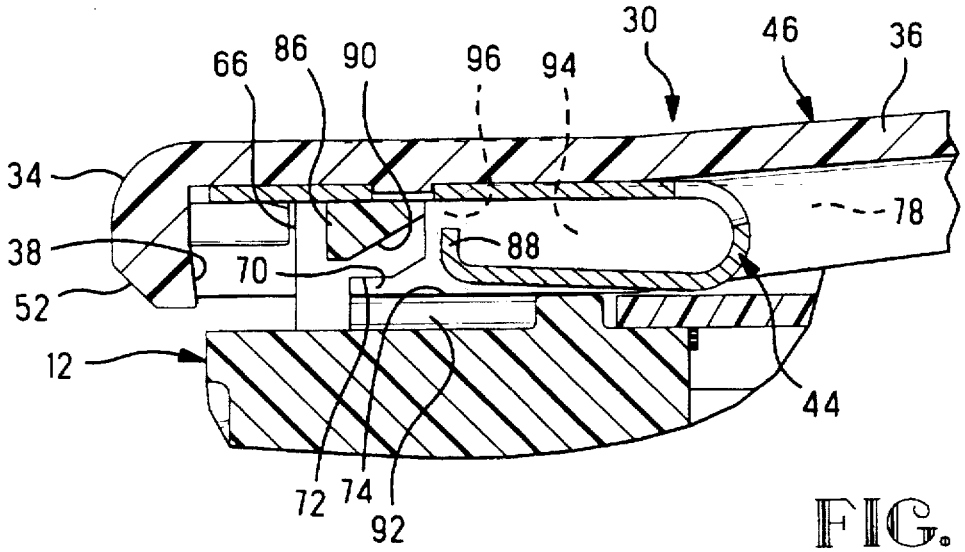
Figure 12:
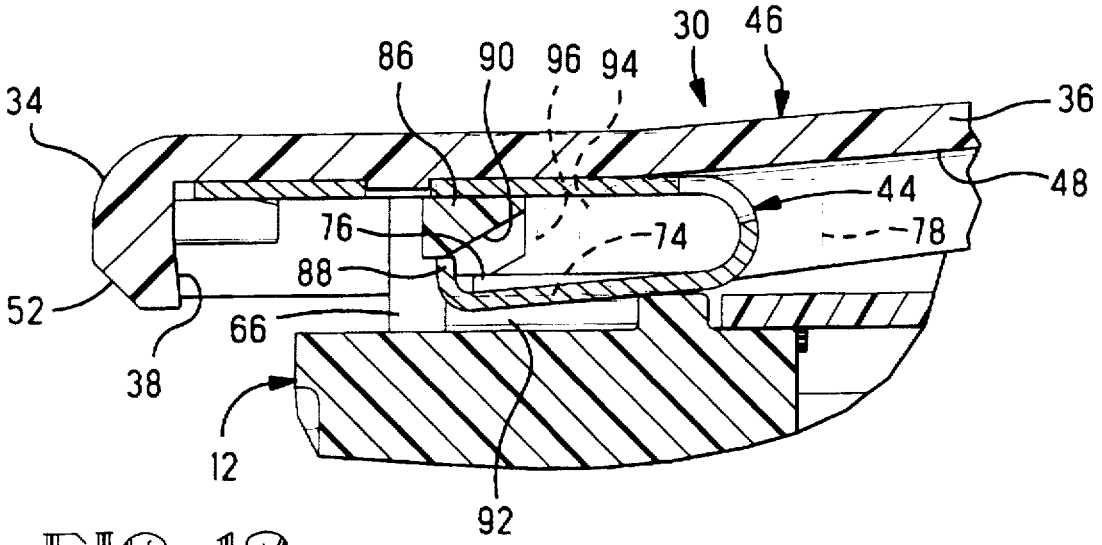
Figure 13:
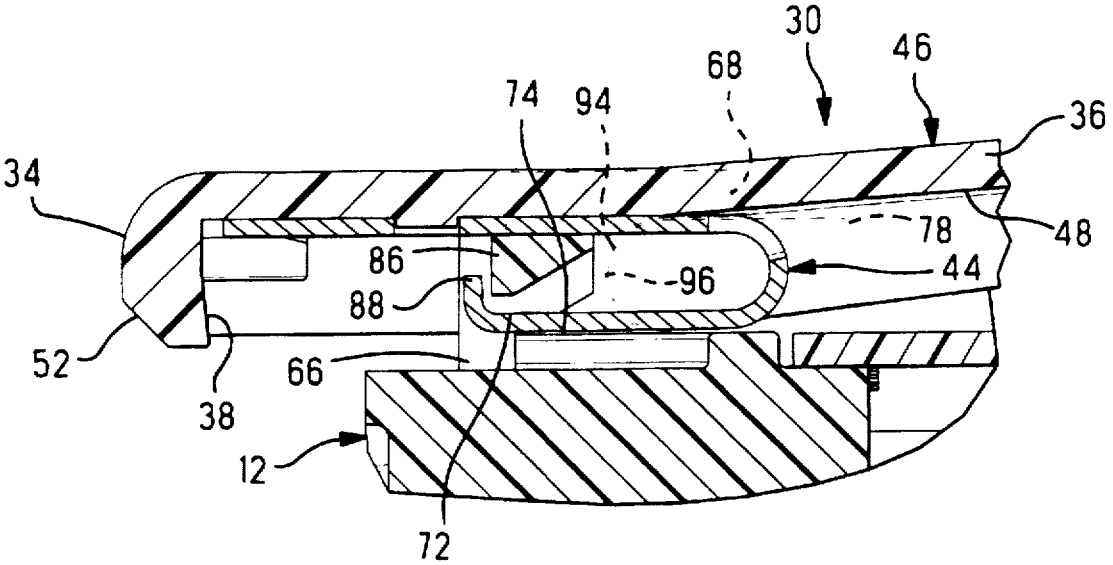

Latching end 34 defines a catch 38 (FIGS. 4 and 8) cooperable with a latching projection 40 of a mating connector 42 (FIGS. 3 to 5) when connectors 10,42 are fully mated. Latching member 30 includes a spring 44 and an elongate arm 46 (FIGS. 6 to 9) to which spring 44 is secured along a connector-proximate surface 48. Spring 44 is held by housing 12 at fastening site 32 so as to urge actuating section 36 outwardly and latching end 34 inwardly, after latching member 30 has been affixed to housing 12. Latching projection 40 of mating connector 42 includes a camming surface 50 facing forwardly and outwardly to engage bearing surface 52 of latching end 34 and initiate deflection outwardly of latching end 34 during mating of the connectors, until latching end 34 passes over latching projection 40 and catch 38 seats therebehind to latch.

With reference to FIGS. 6 to 10, spring 44 is seen to have a doubled-back rear section 54 extending to a free end 56, and also has a planar front section 58. Front section 58 is insertable forwardly into slot 60 proximate latching end 34 of latching arm 46 within channel 48 along the connector-proximate surface, until embossment 62 of latching arm 46 seats in aperture 64.

Referring now to FIGS. 2 and 10 to 13, fastening site 32 of housing 12 includes a fastening section or projection 66 disposed between spaced apart pylons 68. A spring-receiving slot 70 is defined between inwardly-facing surfaces 72 of fastening projection 66 and outwardly facing surfaces of ledges 74 along housing side 20 adjacent respective pylons 68. Latching member 30 is affixable to housing 12 at fastening site 32 by its pivot section being first moved laterally against housing side 20 at fastening site 32 receive fastening projection 66 into channel 48 rearwardly of catch 38. Latching member 30 is then moved forwardly toward mating face 18; side portions 76 of doubled-back spring section 54 are received into slots 70; and embossments or wings 78 along outer surfaces of side walls 80 of latching arm 46 are received into respective recesses 82 extending forwardly along facing surfaces 84 of pylons 68. Free end 56 of doubled-back rear section 54 of spring 44 becomes positioned just rearwardly of a strut 86 of fastening projection 66 positioned extending between pylons 68 of housing 12 and includes a locking section or tab 88 formed to extend toward planar front section 58 of spring 44. Tab 88 engages and bears against camming surface 90 of strut 86, and the middle portion of doubled-back rear section 54 of spring 44 is deflected toward housing 12 into a clearance 92 between ledges 74, while side portions 76 are supported by ledges 74.

Upon completion of the forward movement of latching member 30, wings 78 seat in recesses 82 and tab 88 seats forwardly of strut 86 to secure latching member 30 to the housing against axially rearward movement. Front surfaces of wings 78 are convex to define bearing surfaces 94, and forward ends 96 of recesses 82 are concave to complement the bearing surfaces 94, such that a pivot arrangement is defined between latching member 30 and housing 12, with recesses 82 providing a clearance for relative rotation of wings 78 within in a limited angular range needed for actuation of the latching member. With side portions 76 of doubled-back spring section 54 trapped in slots 70, depression of actuating section 36 of latching member 30 causes front spring section 58 to be pried away from doubled-back section 54 generating spring energy that will urge actuating section 36 outwardly when released.

Figure 14:
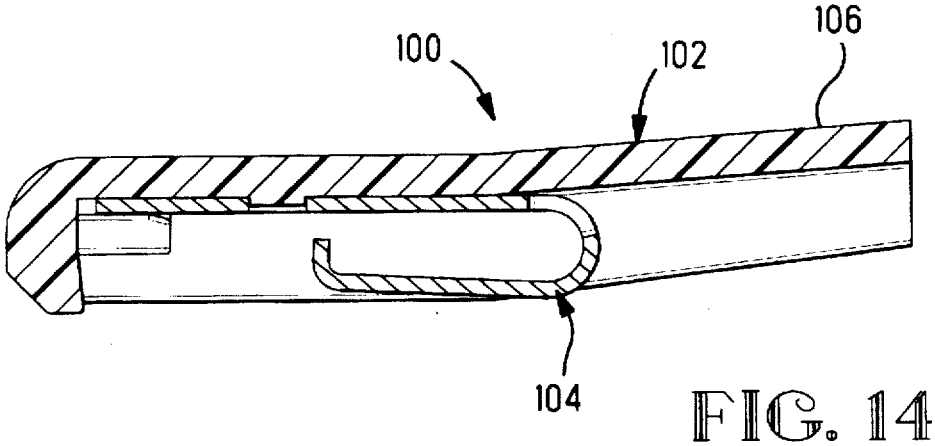
FIG. 14 is a section view of a second latching member having a short latching arm.

FIG. 14 illustrates a second latching member 100 having a latching arm 102 and spring 104, where latching arm 102 provides a shortened actuation section 106. Latching member 100 is affixable to housing 12 of FIGS. 1 to 13, and actuatable, in the same manner as latching member 30.

Delatching is accomplished by actuation of a single latching member in the present invention, and providing a selection of long- and short-armed latching members adapts the connector for being mounted in environments having an overhang or other obstruction above the connector that otherwise would preclude access to an actuating arm of conventional length (i.e., "short") for delatching. The latching member is easily mounted manually, requiring no special tooling. The use of plastic material for the latching arm eliminates a potential shock hazard, while the metal spring member attached thereto allows resistance to the effects of elevated temperature during long-term in-service use.

What is claimed is:

1. An electrical connector assembly, comprising: an electrical connector including a housing, and a latching member affixable to the housing and having an elongate member having a forward end and an elongate actuating arm extending rearwardly therefrom, said latching member having a pivot section mountable to said housing at a fastening site, said pivot section including a biasing section biasing said latching member in a latching position after mounting, with said forward end adjacent a mating face of said connector for latching engagement with a complementary latching section of a mating connector, and with said actuating arm angled outwardly from an adjacent side surface of a rearward end of said connector, said actuating arm to be moved toward said side surface to pivot said forward end away from said mating connector to delatch and to permit unmating, said fastening site including a pair of pylons, each of said pylons comprises a recess along its inner surface, each of said recesses having an open end facing a selected axial direction and a concave recess end, said pivot section including a pair of opposed embossments extending from opposed sides of said latching member, each of said embossments including a convex bearing surface facing an axial direction opposed to said selected axial direction, wherein said embossments are insertable into said open ends of said recesses until said convex bearing surfaces abut said concave ends of said recesses, and said pivot section further including a locking section that locks with a fastening section of said housing to secure said latching member against axial movement after mounting in a manner permitting said embossments to pivot in said recesses over a limited angular distance during connector mating and unmating.

2. The connector as set forth in claim 1 wherein each said recess open end faces rearwardly, and each said convex bearing surface face forwardly, and said embossments are insertable into said recesses from rearwardly thereof until said bearing surfaces are adjacent said recess ends.

3. The connector as set forth in claim 1 wherein said fastening section is a projection having a strut forming an opening along said housing, and said locking section includes a tab extending away from said housing insertable through said opening to seat forwardly of said strut.

4. The connector as set forth in claim 3 wherein said latching member includes a channel along a connector-proximate surface thereof, into which is received said projection, and said tab is disposed at a forward end of a section of a spring securable within said channel of said latching member to be inserted through said opening from rearwardly of said projection during mounting of said latching member, with said spring section deflectable into a clearance beneath said strut such that said tab is cammed toward said housing to ride over said strut prior to seating.

5. The connector as set forth in claim 1 wherein said biasing member is a spring fastenable to a latching arm along a connector-proximate surface thereof between said opposed embossments.

6. The connector as set forth in claim 5 wherein said spring includes a doubled-back resilient section adjacent said housing upon mounting of said latching member to said housing, said doubled-back resilient section being trapped in slots beneath said fastening projection.

7. The connector as set forth in claim 6 wherein said spring includes a planar forward end insertable into a slot at said latching end of said latching member and seats therein.

8. The connector as set forth in claim 7 wherein said spring is disposed in a channel of said latching arm along said connector-proximate surface.

* * * * *